US007117901B2

(12) United States Patent
Martinell Gisper-Sauch et al.

(10) Patent No.: US 7,117,901 B2
(45) Date of Patent: Oct. 10, 2006

(54) APPARATUS FOR FILLING CONTAINERS FOR PHARMACEUTICAL USES AND THE LIKE

(75) Inventors: Enric Martinell Gisper-Sauch, Barcelona (ES); Jordi Menendez Cortina, Barcelona (ES)

(73) Assignee: Probitas Pharma, S.A., Barcelona (ES)

( * ) Notice: Subject to any disclaimer, the term of this patent is extended or adjusted under 35 U.S.C. 154(b) by 0 days.

(21) Appl. No.: 10/084,520

(22) Filed: Feb. 25, 2002

(65) Prior Publication Data

US 2002/0117232 A1 Aug. 29, 2002

(30) Foreign Application Priority Data

Feb. 28, 2001 (ES) ..... 200100473
Mar. 6, 2001 (ES) ..... 200100526

(51) Int. Cl.
*B65B 1/04* (2006.01)

(52) U.S. Cl. ..... 141/2; 141/27; 141/99; 141/234

(58) Field of Classification Search ..... 141/2, 141/9, 21, 25, 26, 27, 99, 100, 102, 104, 141/105, 234, 247; 604/407
See application file for complete search history.

(56) References Cited

U.S. PATENT DOCUMENTS

| | | | | |
|---|---|---|---|---|
| 4,078,583 | A | 3/1978 | Rachavachari | 137/636 |
| 4,187,890 | A | 2/1980 | Stach et al. | 141/27 |
| 4,433,974 | A | 2/1984 | Bischof | |
| 5,911,252 | A | 6/1999 | Cassel | 141/234 |

FOREIGN PATENT DOCUMENTS

| | | |
|---|---|---|
| DE | 448915 | 8/1927 |

*Primary Examiner*—Gregory Huson
*Assistant Examiner*—Peter deVore
(74) *Attorney, Agent, or Firm*—Darby & Darby

(57) ABSTRACT

The apparatus comprises a casing which envelopes a set of drive and control members and is provided with supports for containers holding the medicinal starting solutions and containers for the medicinal output solutions, and is characterized in that it comprises means for supporting and locating a unit for the suction and expulsion of the solutions, combined with a distributor for defining the liquid inlets and outlets, the apparatus having means for the closure of the flexible inlet and outlet tubes of the distributor by pinching and means for actuating the device for the suction and expulsion of solutions, as well as means for the programmed control of the operating cycles of the means for the closure of the flexible tubes by pinching, with means for the input of operational instructions by a keyboard or the like.

12 Claims, 11 Drawing Sheets

APPARATUS FOR FILLING CONTAINERS FOR PHARMACEUTICAL USES AND THE LIKE

DESCRIPTION

The present invention relates to an apparatus for filling containers intended for pharmaceutical uses and the like, that is, an apparatus for the single or repetitive automatic dosage of solutions of various kinds, with programmable volume and proportions, into destination containers of various types. The dosing is performed with the use of a hygienic device that can be replaced when the formulation is changed, preventing the apparatus and the substances used from coming into contact with other drugs.

The invention is applicable to the preparation of solutions in the dose and concentration suitable for each patient, starting with substances held in containers of any type, and in any volume and concentration, for subsequent intravenous administration to the patients.

The apparatus of the invention has two functions which can equally well be implemented separately or in combination. On the one hand, it can prepare formulations in solution in accordance with a preset program, from stock solutions which can be dosed, in containers (generally vials) in sterile or non-sterile form, possibly according to whether the formulation can withstand a heat sterilization process or not, or which may be dispensed sterile as a result of filtration through membrane filters. In this case, since the effectiveness of filtration for ensuring sterilization depends on the integrity of the membrane, the apparatus checks the membrane automatically by the so-called bubble test. Dispensing into the final containers must take place with the maximum guarantee of sterility, either in laminar-flow cabinets, or with the use of flexible plastics containers in which an irremovable membrane filter is incorporated prior to sterilization, which is the optimal solution.

The main use of the apparatus of the present invention is to enable the solution for administration to be prepared with the appropriate composition in hospitals' own pharmacy departments. The apparatus which is the subject of Spanish utility model No. 9300684 was also intended for filling containers for pharmaceutical use, particularly for the infusion of solutions but, in said utility model, the apparatus was of the type with a gear pump with which the solutions handled in the apparatus came into contact, and thorough cleaning was necessary when the type of solution was changed. Moreover, the volume dosed was controlled by weight.

The object of the present invention is to provide an apparatus in which various components of a medicinal solution can be combined easily without the need for subsequent washing of internal parts of the apparatus, permitting volumetric programming of the dose with preliminary programming of the doses by the operator and with dosing performed automatically, precisely and safely.

An essential element of the invention is that the apparatus of the invention has means for actuating an element for the displacement of a plunger and cylinder unit which acts as a pump, bringing about suction and expulsion by controlled displacement of the plunger, and means for the opening and closure of a series of ducts of a distributor unit which connects the apparatus to the various containers for the components of the solutions and to the final containers for holding the solutions, as well as air for performing the bubble test on bags having sterilizing filters, as described in Spanish utility model No. 9103692.

When filling the said bags or other containers with filters in sterile form, starting with solutions which are also sterile, the apparatus of the present invention will test the integrity of the filter by compressing air to a pressure slightly below the bubble point of the filter for the last substance dosed and checking that the pressure does not fall, for example, during a period of 5 seconds, which shows that, at this pressure, the air cannot overcome the surface tension of the liquid blocking the pores, demonstrating that the diameter of the pores is correct and that the filter has not deteriorated.

The apparatus of the present invention thus comprises an electromechanical apparatus which is installed mainly in hospital pharmacy departments and which enables the operator (a trained laboratory technician) to program the doses and proportions required for each patient, the apparatus performing the dosage automatically, accurately, and safely. The design of the apparatus, as well as its various functions, provide all of the information (visual by means of a screen and printed by means of an external printer or PC) and control devices (keyboard) necessary for the operator to perform the process.

The apparatus is particularly suitable for the use of a device which is constituted by a plunger and cylinder element, for example, a syringe, with a distributor connected to the pump and to the set of starting and collecting containers for the solutions and for air, and which is completely removable, being a disposable device composed substantially of a syringe as impulsion and dose-control means and a distributor the outlets of which are pinched selectively by valves of the invention in order to regulate the flow of the liquids during the process. The said distributor has several ducts, for example, six ducts which communicate with a common central point of the distributor and which can be put into communication with one another in a previously programmed manner. A first duct is connected to the plunger pump, for example, a syringe, a second duct is used for the admission of air through a membrane filter, a third is connected to a container for the discharge of surplus purging fluids, a fourth is connected to the destination container, and a fifth is connected to the container of the starting solution, if the process is limited to the splitting-up of a container into individual doses for patients. If the concentration of the starting solution is to be modified by the addition of a diluent, the container of the diluent is connected to the sixth duct of the distributor. If this is not the case, the sixth duct is blocked by means of a plastic element inserted therein.

If the starting solution is in a container in non-sterile form, an extension may be connected to the disposable sterile device to facilitate connection to the container. The extension is composed substantially of a tube with a male Luer lock connector on one end and a twist-off valve on the other end.

If the starting solution is in bottles of small volume in comparison with the dose required for the patients, it is possible to connect to the disposable sterile device a similarly disposable and sterile device for enabling the liquid to be drawn in from up to six bottles connected simultaneously. It is also possible to insert the suction tube of the disposable, single-use device into a housing in the front of the apparatus which enables exhaustion of the starting containers to be detected by means of an optical detector.

The process consists basically of a series of successive steps which are indicated in summary below:

a) preparing the apparatus (setting in operation and programming of the dosage parameters: the substance/s to be used and their dosage parameters, dose, concentration, method of operation) and giving the command to perform the process;

b) fitting the disposable device in its housings on the front of the apparatus;

c) fitting the container/s with the starting substance/s in the support/s of the apparatus;

d) piercing the container/s of the starting substance/s with piercers/s connected to the distributor;

e) connecting the destination container.

Once these operations have been performed by the user, the apparatus will continue the process in accordance with the parameters programmed, as indicated in summary below:

a) drawing in a small volume of liquid to purge the ducts of the disposable device;

b) eliminating the purging air which has remained in the syringe, into the discharge container;

c) drawing in the programmed volume (if it is more than 50 ml the dosing is split up into repetitive 50 ml cycles and a last cycle with the remainder of less than 50 ml);

d) discharging the liquid from the syringe into the destination container;

e) if the programmed dose is not completed, repeating steps c) and d);

f) once the dose is completed, if the destination container has a 0.22 μm filter, drawing in air and attempting to discharge it into the destination container at the integrity-test pressure for the solution used; if dosing is not possible, the filter will be considered correct;

g) printing a label with the composition of the destination container and the result of the integrity test.

Once the filling of the end container is completed, the apparatus will allow the user to repeat the process as many times as required; the dose and the concentration of the preparation may be modified. It is not possible to change the starting substance/s without discarding the disposable device.

If any starting substance is exhausted during the process, the apparatus will draw in air and, before discharging the liquid from the syringe into the destination container, will detect the presence of the air by ascertaining that the content of the syringe is compressible, warning the user of this situation and enabling the exhausted starting container to be replaced and normal operation to continue (after purging of the disposable device) or enabling the liquid portion of the content of the syringe to be dosed into the destination container and the process to be completed.

If the user wishes to detect the exhaustion of the starting solution before the air drawn in reaches the distributor and the syringe, and if the starting solution is sufficiently transparent, the tube of the disposable device which is connected to the starting container can be inserted in a housing provided on the front of the apparatus, in which an optical device enables exhaustion of the solution to be detected.

The apparatus will enable the users performing the preparations to be identified by means of a name and an access code. The user's name will appear on the printed label to permit traceability.

Figure 1:
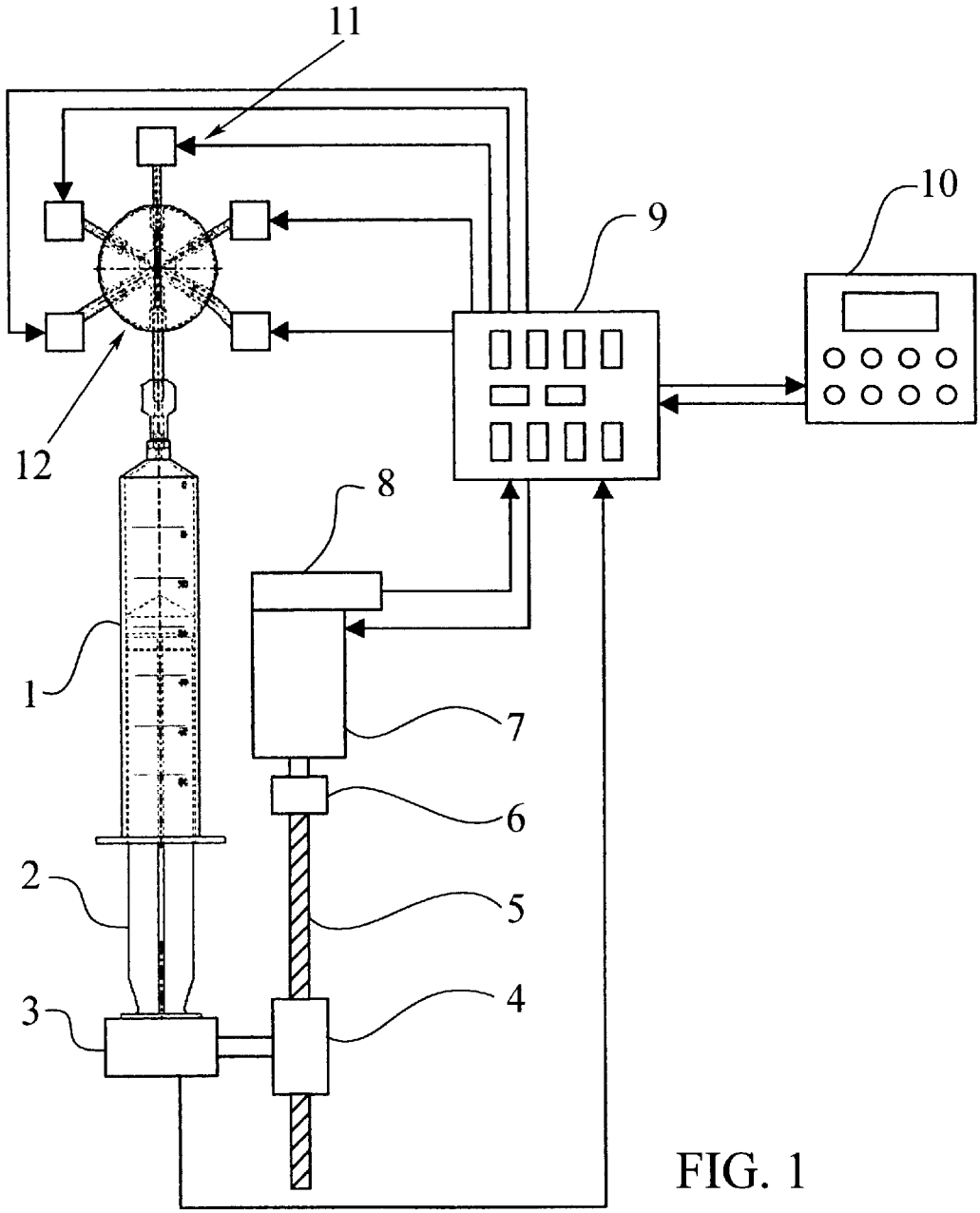
FIG. 1 shows, in simplified manner, the set of elements making up the apparatus of the present invention, which enable the method of the invention to be implemented.
Figure 2:
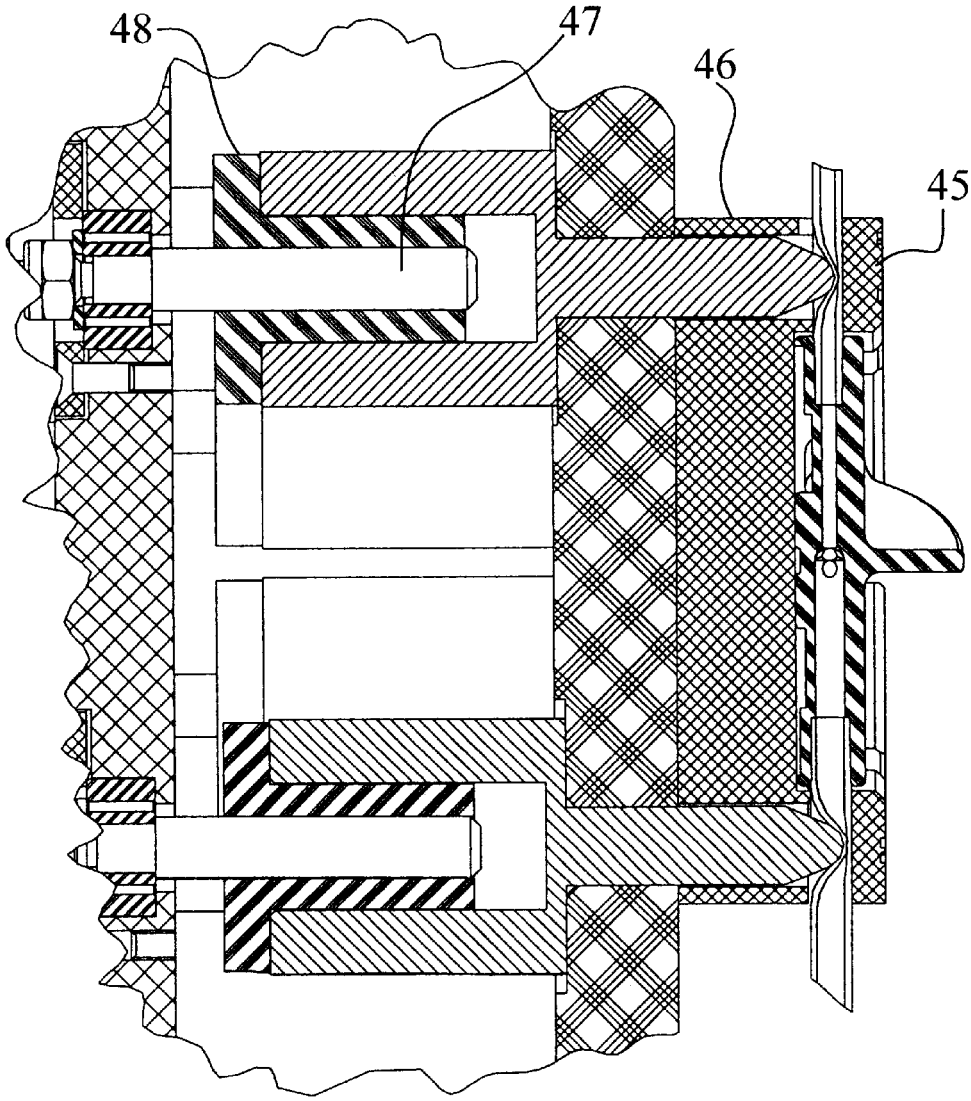
FIG. 2 is a simplified view of the tube-pinching valve mechanism.

According to the drawings and, in particular, according to the schematic view of FIG. 1, the apparatus of the invention comprises a sterile, disposable device composed, for example, of a pump with a cylinder and a plunger, for example, a syringe 1, and a distributor 12, which are fitted in the housings provided for that purpose on the front of the apparatus. An electronic circuit board 9 will generate electrical pulses to five motors of valves 11 and to a motor 7 for actuating the plunger 2 of the syringe 1 in order to control the suction and discharge of liquid and air in accordance with the parameters programmed by the user. Each of the valves 11 is formed by as fixed portion 45 and, by a further, movable portion 46 (FIG. 2) which blocks or opens the passageway for the liquid through the tube inserted between the two portions. The movable portion 46 is displaced linearly by a screw 47, a female screw 48 of which is fixed to the movable portion 46. The screw 47 is also actuated by a motor (not shown). Volume measurement is performed indirectly by a respective optical encoder 8 connected to the motor 7 for actuating the plunger 2. A screw 5 connected to this motor 7 by a coupling 6 brings about the linear movement of the plunger 2 of the syringe 1 which is fitted in a housing 3 that moves together with a female screw 4 of the screw 5. The housing body 3 comprises a load cell, not shown, which converts the force exerted on the plunger 2 into an electrical signal which is processed by the control board 9 so that, since the diameter of the plunger 2 and the force exerted thereon are known, it is possible to obtain the pressure of the fluid in the syringe 1 indirectly and thus to control the motor 7 by means of a control algorithm which ensures that this pressure corresponds to that programmed by the user.

Information is exchanged with the operator by means of a keyboard and screen unit 10. The operator will program the characteristics of the solutions and the doses and concentrations of the preparations, as well as further auxiliary functions, and will receive information on the state of the process at any moment.

Figure 3:
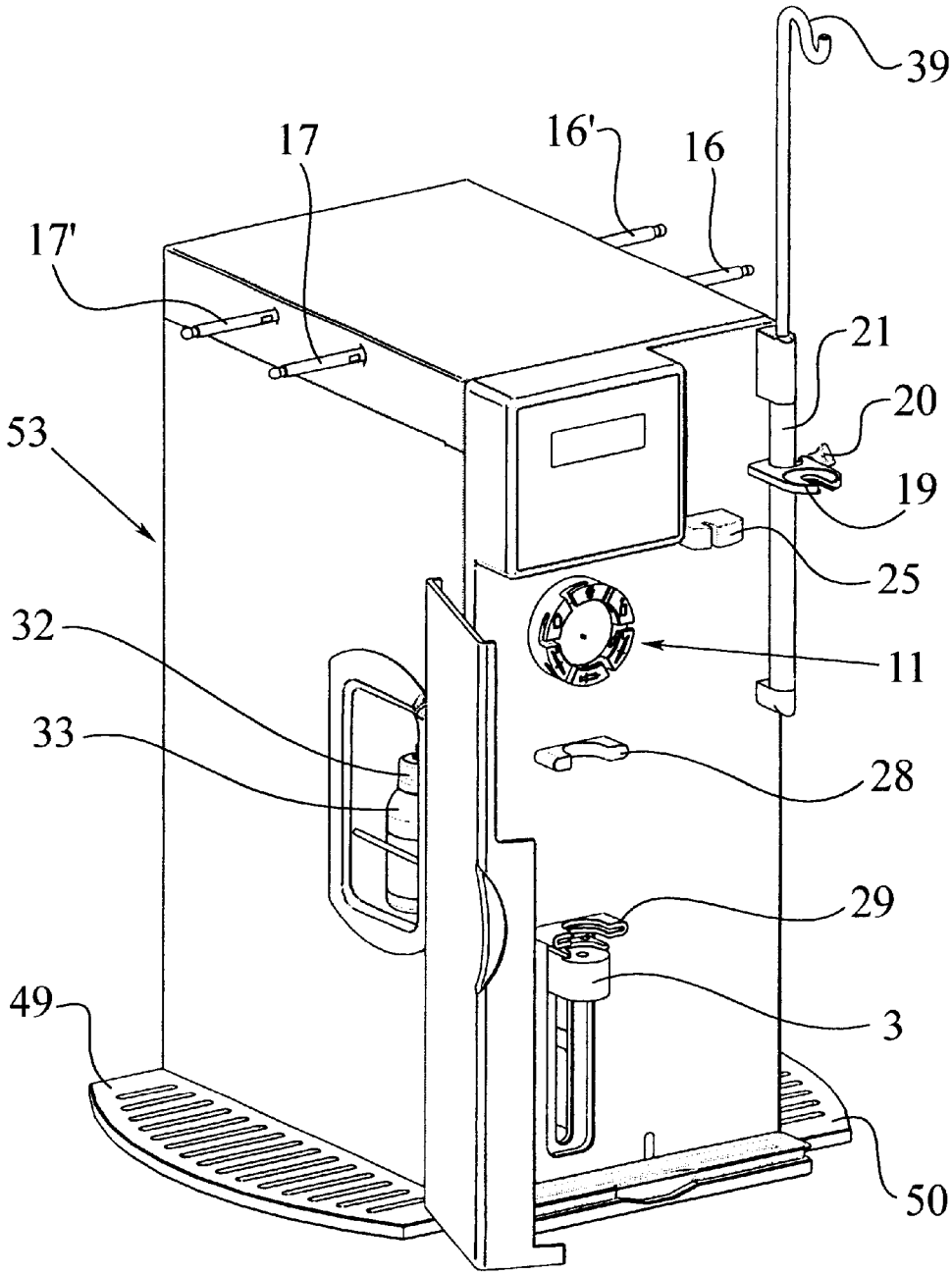
FIG. 3 is a simplified perspective view of the apparatus of the present invention.
Figure 4:
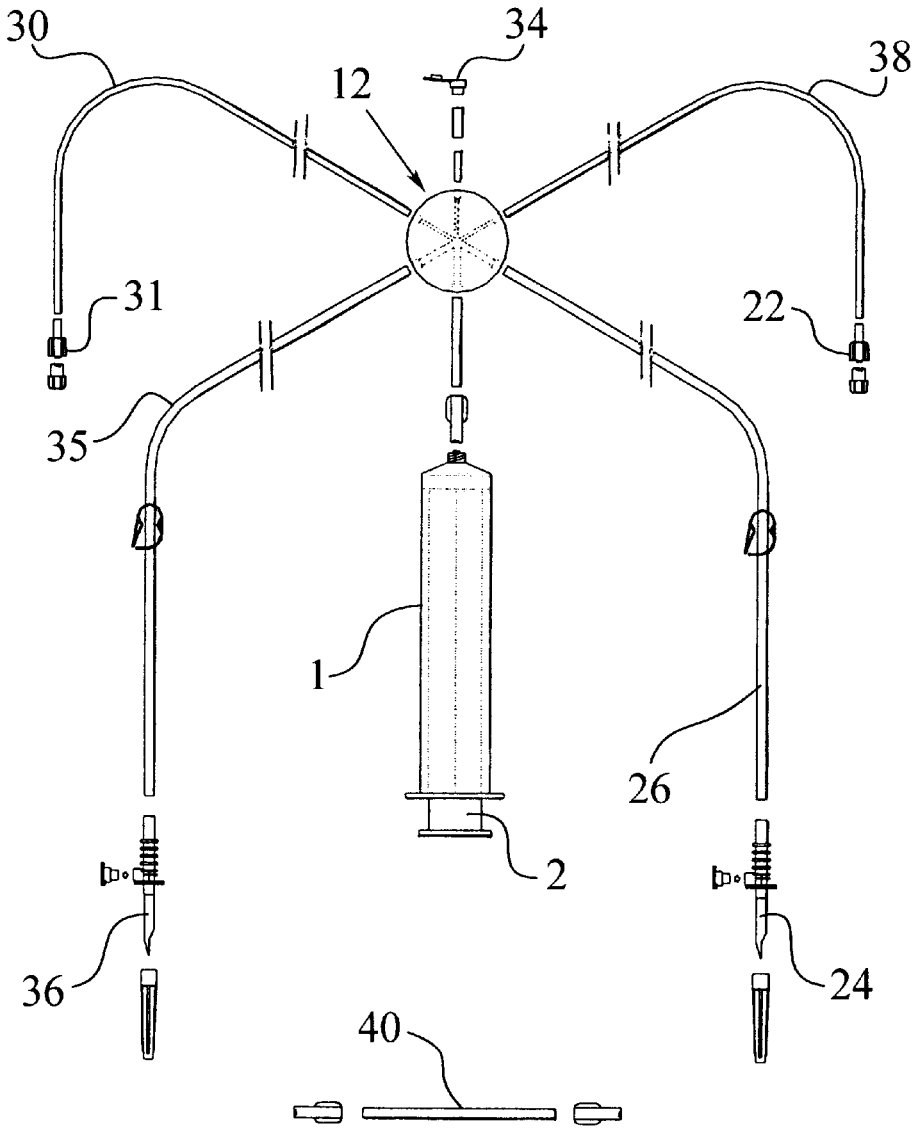
FIG. 4 is a simplified view of the distributor in the form of a sterile, disposable device.
Figure 6:
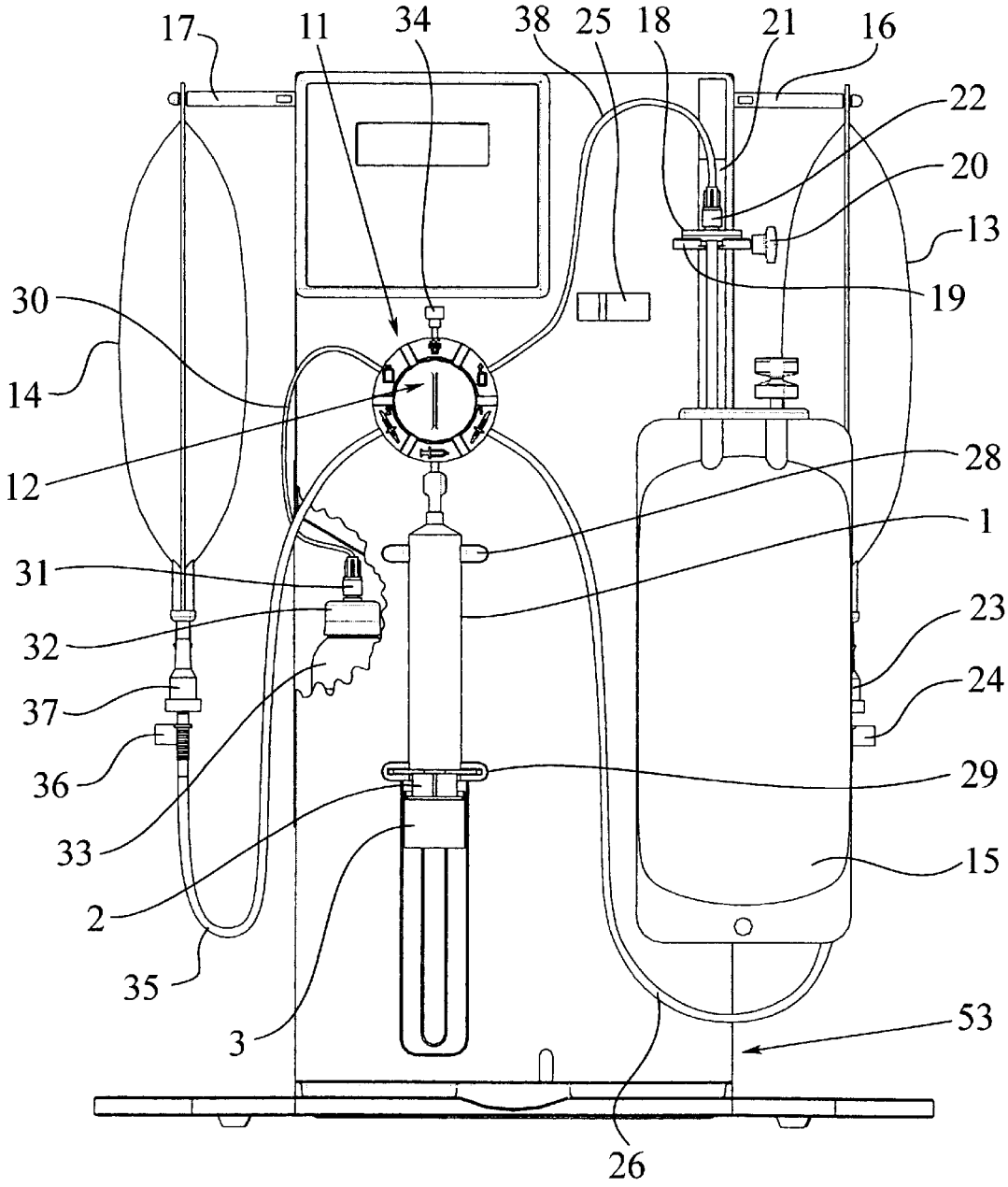
FIG. 6 is a simplified view of the arrangement of the elements in the apparatus during a process for splitting up starting solutions with mixing of two substances in order to modify the concentration.

According to the drawings and, in particular, according to the schematic view of FIG. 6, during a splitting process, the container 13 of the starting solution is suspended from support rods 16 (or 39, FIG. 3, if a bottle is used). If solutions are to be mixed, the second container 14 will also be suspended from support rods 17. The end or destination container which, in the embodiment of FIG. 6, is a bag 15 with a 0.22 μm filter 18, will be suspended in a support 19 which will be fixed at the desired height on a bar 21 by means of a screw clamp 20. The sterile, disposable device will be fitted on the front of the apparatus. The syringe 1 will be fixed to upper and lower supports 28 and 29. The plunger 2 of the syringe 1 will be fixed in the housing 3. The distributor 12 will be fixed on the fixed body of the valves 11. The five ducts of the distributor 12 (the sixth is connected to the syringe 1) will be connected as follows: a first duct will be connected to the container 13 of the starting solution by means of a tube 26 and by thrusting a piercer 24 at the end of the tube into the neck 23 of the said container. A second duct will be connected to the destination container by means of a tube 38 and by connecting a male Luer connector 22 at the end of the tube to the 0.22 μm filter 18. If the destination container is a device with a male Luer connector, a male-male Luer adapter 40 (FIG. 4) will be inserted between the male Luer connector 22 of the disposable device and the said destination container. A third duct will be connected to a membrane filter 34 to enable air to be drawn in for the integrity test. A fourth duct will be connected to the discharge container 33 by means of a tube 30 and by connecting a male Luer connector 31 at the end of the tube to the female Luer 32 fitted in the cap of the discharge container 33, A fifth duct will remain blocked for splitting or will be connected to the second container 14 of starting solution by means of a tube 35 and by thrusting a piercer 36 at the end of the tube into the neck 37 of the said container. If the optical liquid-detection device is to be used, the tube 26 will have to be fitted in a housing 25 of the detector.

FIG. 3 shows a casing 53 of the apparatus which carries the supports 16, 16', 17, 17' for bags and containers as well as support bases 49 and 50, the body of the valves 11 and the housings 28 and 29 for the syringe 1, as well as the housing 3 carrying the load cell.

Figure 5:
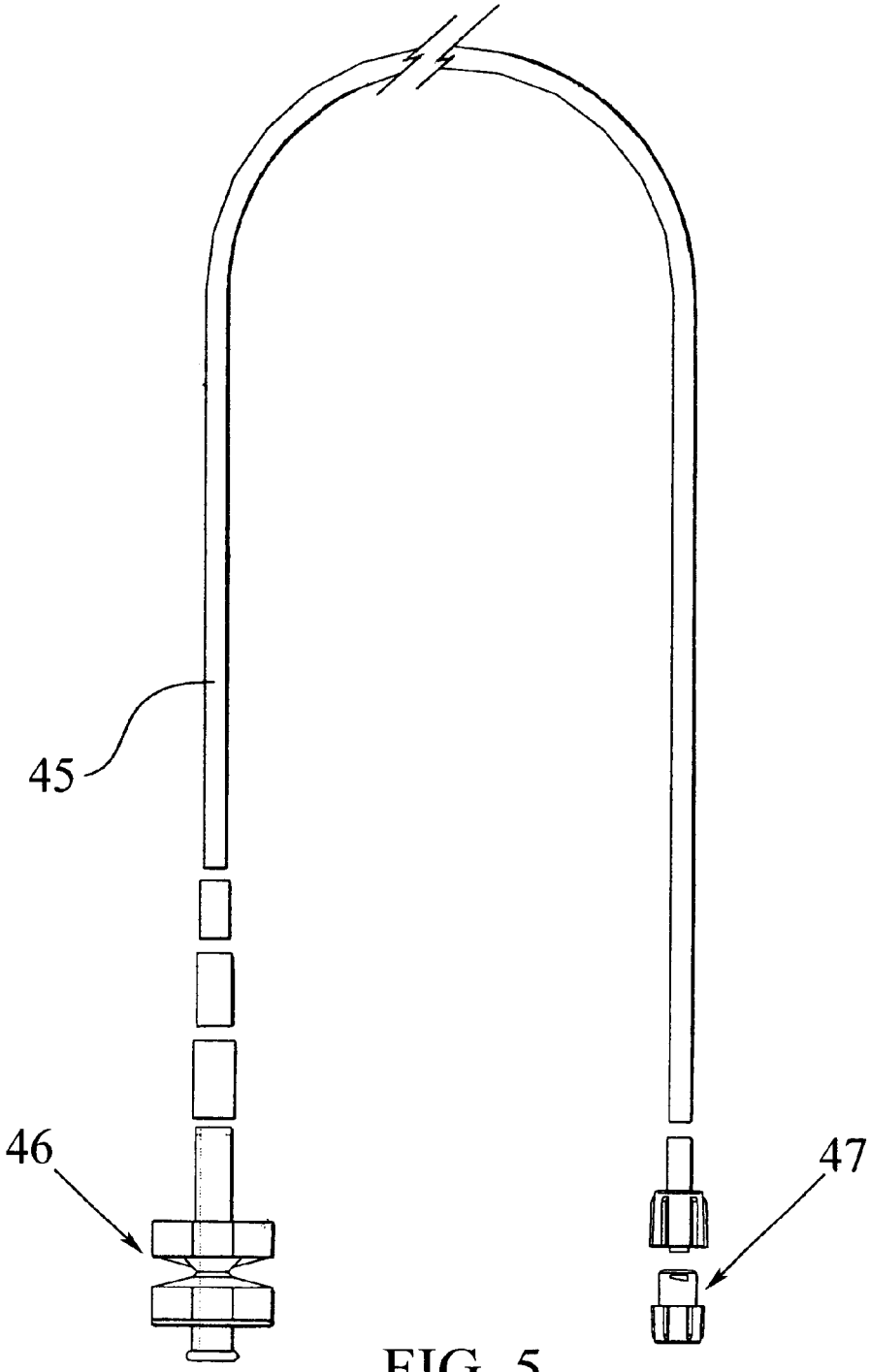
FIG. 5 is a simplified view of the extension for filtration of non-sterile starting solutions.

FIG. 5 is a simplified view of an extension 45 for the filtration of solutions which are not originally sterile; the extension comprises end couplings 46 and 47, of which the former comprises a "twist-off" device. The extension may also be used for filling large bags, of the order of 3 liters, from reservoirs.

Figure 7:
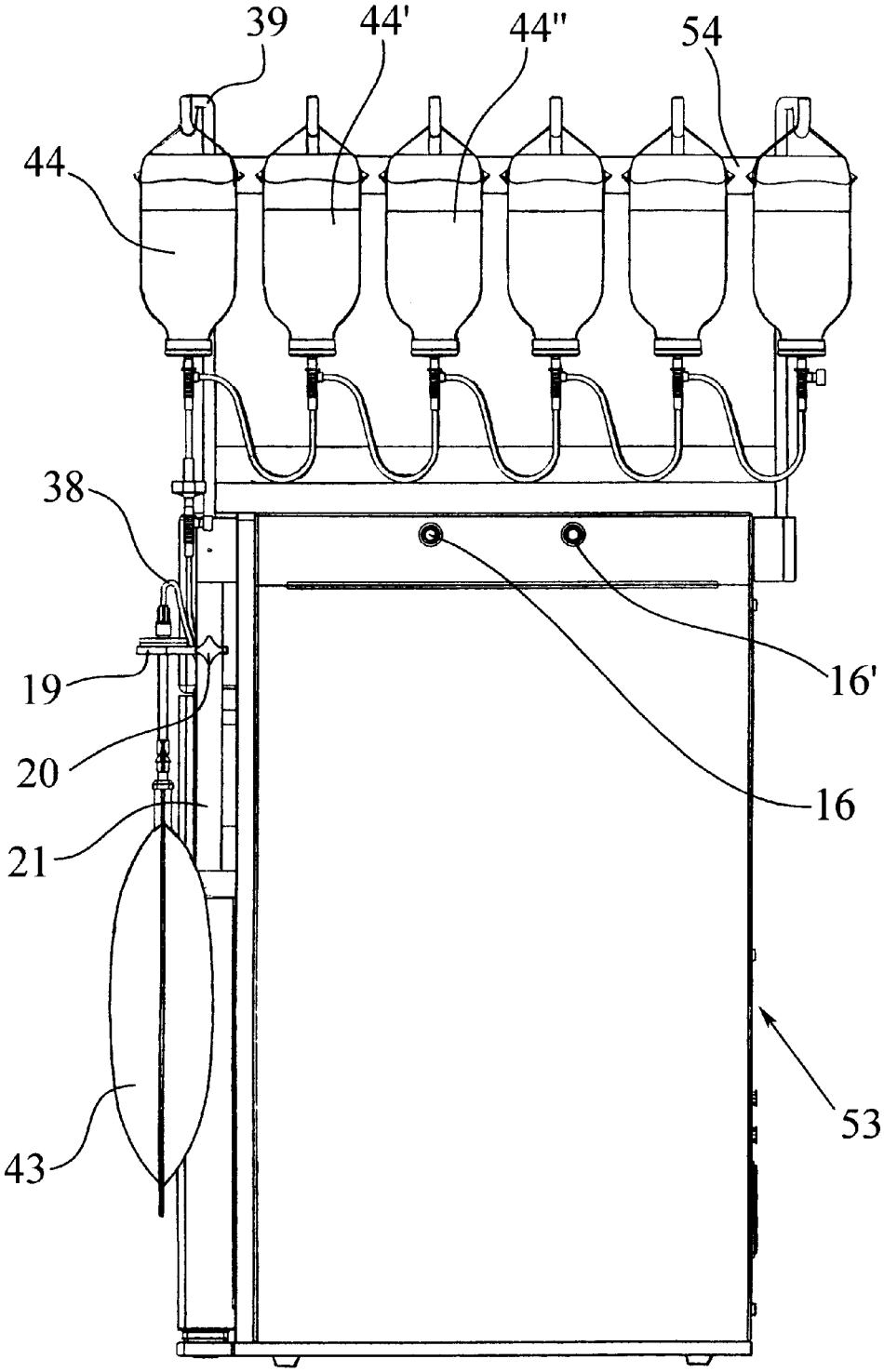
FIG. 7 is a simplified view of the arrangement of the elements in the apparatus during an adding process for the preparation of doses larger than the volume of the individual starting containers.
Figure 8:
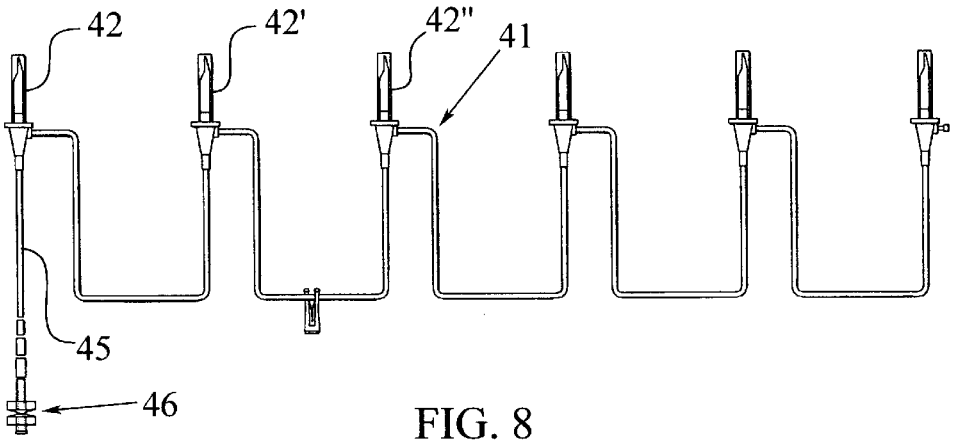
FIG. 8 is a simplified view of the sterile, disposable device which enables 6 bottles to be connected simultaneously.
Figure 9:
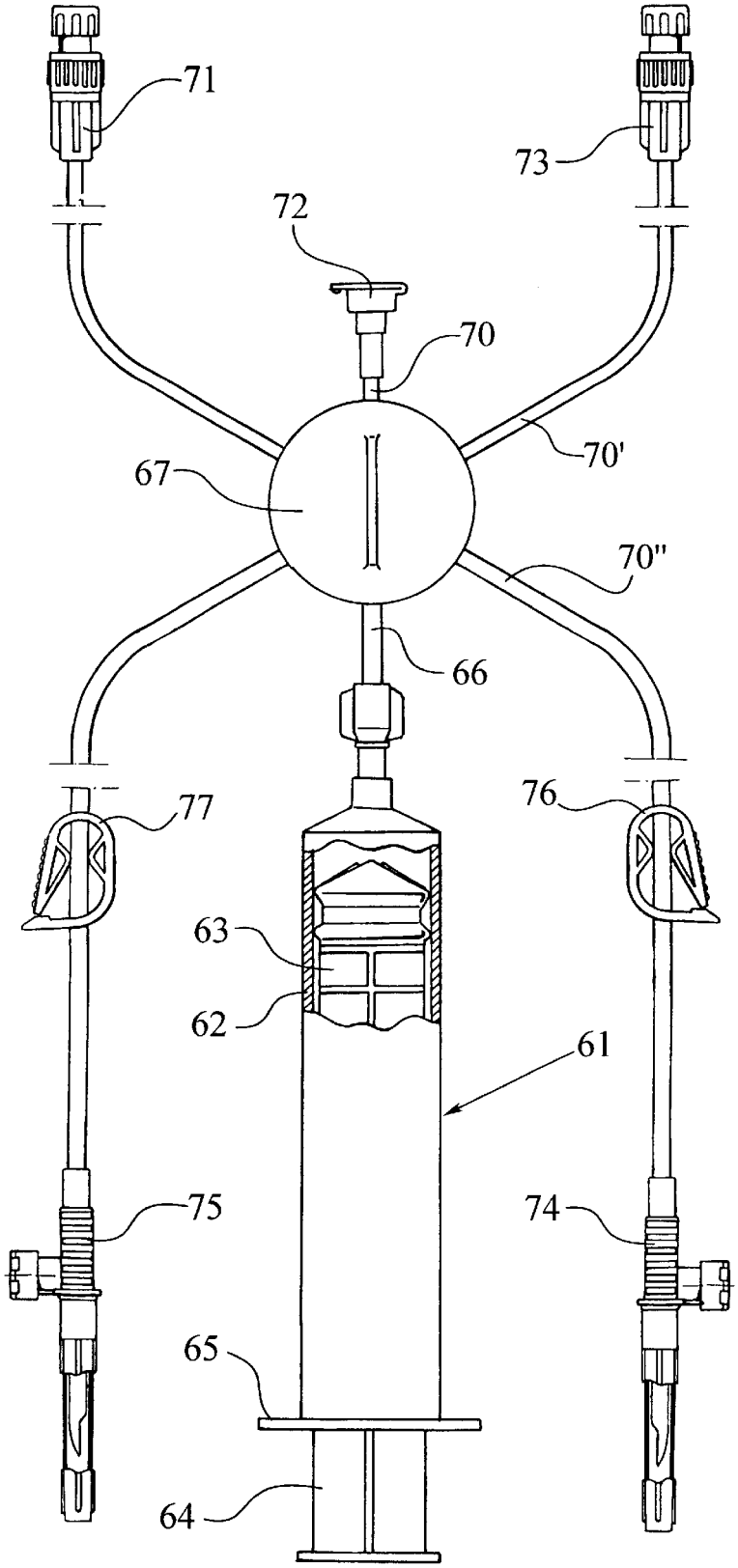
FIG. 9 shows a preferred embodiment of the device composed of a plunger and cylinder pump, a central distributor, and several tubes for connection to inlets and outlets.

It is also possible to fill containers starting with different components in separate containers, as can be seen in FIGS. 7 and 8 which show a manifold of tubes 41 which is provided with various inlets 42, 42', 42", . . . for respective containers, and from which a single container 43 is supplied.

According to the drawings and, in particular, according to the schematic view of FIGS. 7 and 8, if the starting solutions are in bottles, it is possible to use a sterile disposable device for connecting up to six bottles 41, the device being formed by means of 6 piercers interconnected by tubes 42 and terminating in a twist-off 46 into which the piercer 24 of the sterile disposable device fitted in the apparatus is thrust. The bottles will be suspended on respective support hooks 54 of a support, and a corresponding piercer will be thrust into each of them.

Figure 12:
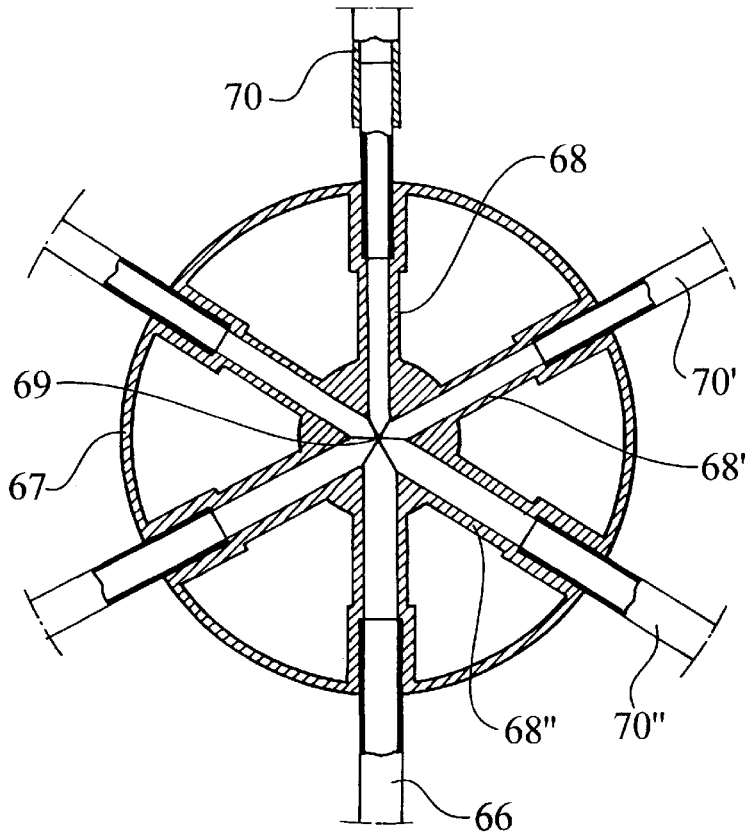

In the embodiment of FIGS. 9 to 12, the device of the present invention comprises a pump 61, preferably a pump with a cylinder and a plunger, provided with an outer cylinder 62 and an inner plunger 63 actuated by its rod 64; the rod 64 projects through the lower end of the tubular element 61 which has a collar 65 or other similar means for optional fixing thereof, to enable the plunger to be actuated by displacement of the rod 64 without bringing about displacement of the cylinder 62. The cylinder 62 is connected, by a flexible tube 66, to a distributor 67 which is circular or of another suitable shape and which, as can be seen in FIG. 12, will preferably be constituted by an element provided with radial ducts such as 68, 68', 68", . . . , all of which open in a single central point 69 in which the suction or compression of the pump 61 is exerted.

The internal tubular ducts 68, 68', 68", . . . , are connected to external flexible tubes such as 70, 70', 70", . . . , the ends of which are connected to terminals of various types such as those indicated, by way of example, by the numerals 71, 72, 73, 74 and 75. The said terminals will be suitable for connection to input containers, that is, starting containers for the solutions to be handled by the device, to air inlets and outlets, or to the destination container.

An essential characteristic of the present device is that the external tubular elements 70, 70', 70", . . . , are flexible, which enables them to be controlled by transverse compression by compression rods, pincers or other systems; these can be programmed in a suitable manner to bring about, in a manner coordinated with the axial suction and compression displacements of the plunger 63, the ingress of fluid through the desired duct or ducts and its subsequent egress towards further ducts leading to the outlets which may lead to bags of substances to be infused into patients, small syringes, or other means for transporting the medicinal product for its despatch for medical use.

Figure 10:
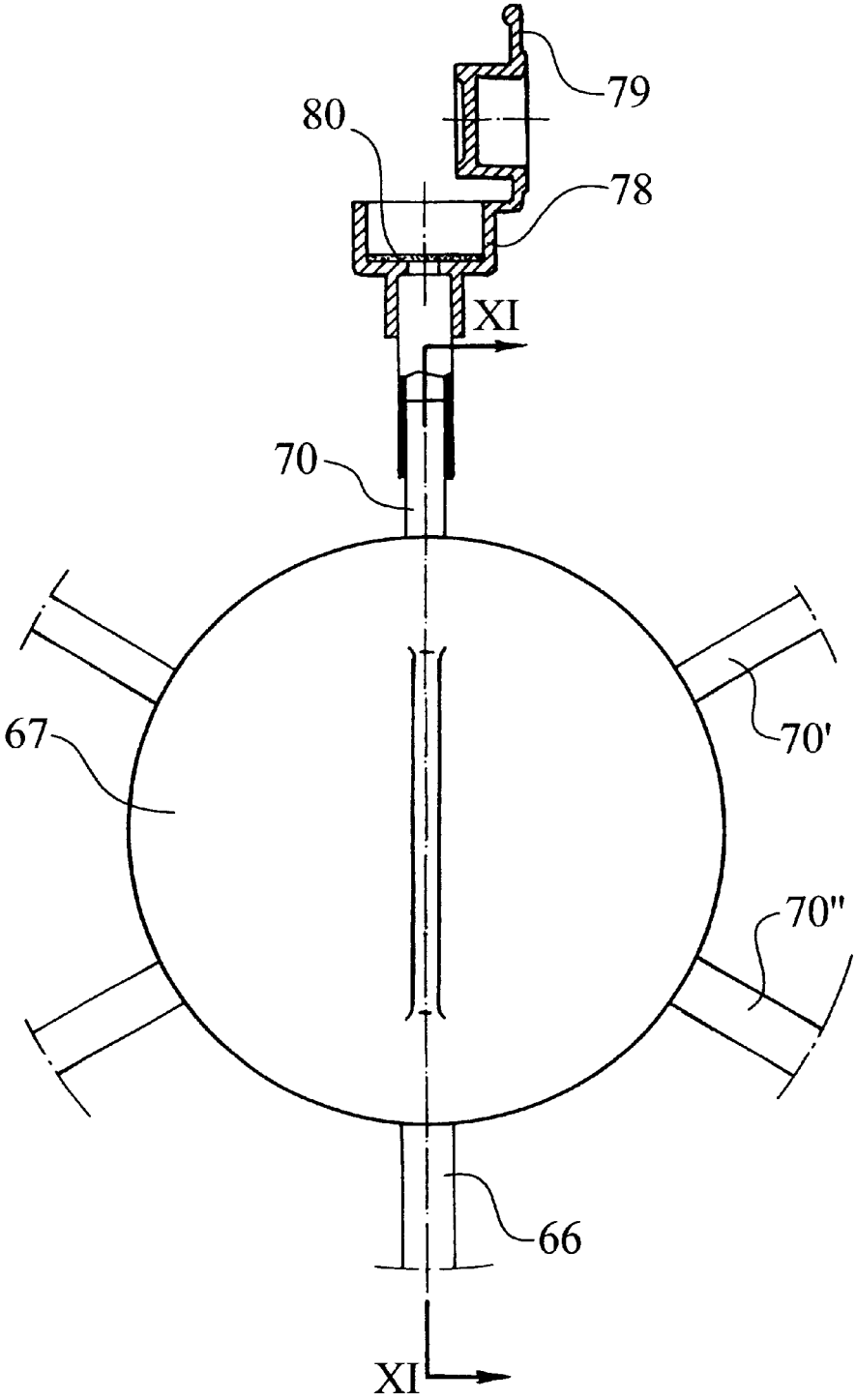
FIG. 10 shows a detail, sectioned as indicated.
Figure 11:
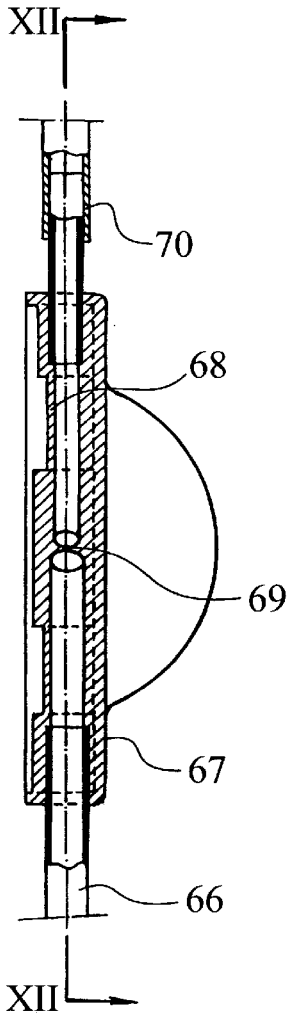
FIGS. 11 and 12 are respective sections through the distributor, taken in the section planes indicated.

As can be seen in FIG. 10, the terminal of the flexible tube 70 is constituted by a small cup 78 closed by an optional cover 79 and having an internal membrane 80 for filtering the air which is impelled towards the interior of the device by the pump. It should be understood that this terminal is purely an example of the many terminals which may be incorporated in the device of the present invention.

The device of the present invention will permit very easy manufacture and handling since it can be made entirely of plastics material, preferably by injection, especially all of the central distributor 67.

What is claimed is:

1. Apparatus for filling containers for pharmaceutical uses, comprising a casing which envelops the set of drive and control members and has supports for containers holding the medicinal starting solutions and containers for the medicinal output solutions, the apparatus being characterized in that it comprises means for supporting and locating a unit for the suction and expulsion of the solutions, combined with a distributor for defining the liquid inlets and outlets, the apparatus having means for the closure of the flexible inlet and outlet tubes of the distributor by pinching, means for actuating the unit for the suction and expulsion of solutions, means for the programmed control of the operating cycles of the means for the closure of the flexible tubes by pinching, and means for the input of operational instructions by a keyboard, said device for actuating the plunger of the unit for the suction and expulsion of solution comprising a rotary screw and a female screw which is guided longitudinally and is coupled to the plunger.

2. Apparatus for filling containers for pharmaceutical uses according to claim 1, characterized in that the distributor has a plurality of radial ducts which communicate at a central point and which are connected externally to flexible tubes, of which one communicates with a pump for the suction and expulsion of the solutions and the remainder communicate with sources of the solutions to be dosed and containers for the receipt or dispatch of the medicinal substances or mixtures thereof that are handled by the apparatus.

3. Apparatus for filling containers for pharmaceutical uses according to claim 1, characterized in that the distributor is formed as a single unit of injection-moulded, thermoplastic material.

4. Apparatus for filling containers for pharmaceutical uses according to claim 1, characterized in that the unit for the suction and expulsion of the solutions and of air is constituted by a gauged cylinder provided with means for fitting it releasably in the casing of the apparatus, and a plunger which slides inside the said cylinder and which can be advanced and retracted by said actuating device of the apparatus.

5. Apparatus for filling containers for pharmaceutical uses according to claim 1, characterized in that it comprises means which can be programmed manually by means of a keyboard or by a programming card in order to preset the order and time of pinching of the various flexible tubes of the distributor and also the actuation of the plunger of the device for the suction and expulsion of solutions in order to define the quantity of solution drawn in and/or expelled.

6. Apparatus for filling containers for pharmaceutical uses comprising a casing which envelops the set of drive and control members and has supports for containers holding the medicinal starting solutions and containers for the medicinal output solutions, the apparatus being characterized in that it comprises means for supporting and locating a unit for the suction and expulsion of the solutions, combined with a distributor for defining the liquid inlets and outlets, the apparatus having means for the closure of the flexible inlet and outlet tubes of the distributor by pinching, means for actuating the unit for the suction and expulsion of solutions, means for the programmed control of the operating cycles of the means for the closure of the flexible tubes by pinching, and means for the input of operational instructions by a keyboard, said means for the closure of the flexible tubes of the distributor by pinching comprising individual rods actuated from inside the apparatus by axial drive elements, each of said rods being able to act on a corresponding tubular element connected to the distributor for the closure thereof by pinching of the said tube against a rigid region for guiding the tube, said drive elements being displaced axially by individual devices each comprising a drive motor, a rotary screw, and a movable female screw.

7. A method of filling containers with sterile solutions and/or mixtures thereof with an apparatus of the type comprising a casing which envelops a set of drive and control members and includes supports for containers holding a medicinal starting solution and containers for the medicinal output solutions, the apparatus further comprising means for supporting and locating a unit for the suction and expulsion of the solutions, and a distributor for defining the liquid inlets and outlets, the apparatus having means for the closure of the flexible inlet and outlet tubes of the distributor by pinching, and means for actuating the unit for the suction and expulsion of solutions, said apparatus further having means for the programmed control of the operating cycle of the means for the closure of the flexible tubes by pinching, with means for the input of operational instructions by a keyboard, said method characterized in that in the first place the dosing parameters are programmed in accordance with the substances to be used and their proportions and dose parameters, a disposable device being fitted in said housing and the containers of the starting substances being fitted on the supports of the apparatus, the containers of the starting substances being connected to the distributor and the destination container, said apparatus being operable to automatically draw in a small volume of liquid to purge the ducts of the disposable device and to eliminate towards a discharge container purging air which has remained in the unit for the suction and expulsion of solutions, drawing in the programmed volume in at least a single cycle, and discharging the liquid from the suction and expulsion unit into the destination container, said destination container being provided with a molecular filter, and the further step of drawing in air and compressing it, and discharging it into the destination container.

8. The method of claim 7, including repeating the suction and discharge steps to complete the programmed dose.

9. Apparatus for filling containers for pharmaceutical uses comprising a casing which envelops the set of drive and control members and has supports for containers holding the medicinal starting solutions and containers for the medicinal output solutions, the apparatus being characterized in that it comprises means for supporting and locating a unit for the suction and expulsion of the solutions, combined with a distributor for defining the liquid inlets and outlets, the apparatus having means for the closure of the flexible inlet and outlet tubes of the distributor by pinching, means for actuating the unit for the suction and expulsion of solutions, means for the programmed control of the operating cycles of the means for the closure of the flexible tubes by pinching, means for the input of operational instructions by a keyboard, and a pressure sensor which is associated with the plunger of the unit for the suction and expulsion of solutions, and which can send a signal related to the minimum compressed-air pressure which a molecular filter of a container to be filled can withstand in order to test the integrity of the filter.

10. Apparatus for the filling of containers for pharmaceutical uses according to claim 9, characterized in that the integrity test is performed by compressing air to a pressure below the bubble point of the filter for the last substance dosed and checking that the pressure does not fall during a period of a few seconds.

11. Apparatus for the filling of containers for pharmaceutical uses comprising a casing which envelops the set of drive and control members and has supports for containers holding the medicinal starting solutions and containers for the medicinal output solutions, the apparatus being characterized in that it comprises means for supporting and locating a unit for the suction and expulsion of the solutions, combined with a distributor for defining the liquid inlets and outlets, the apparatus having means for the closure of the flexible inlet and outlet tubes of the distributor by pinching, means for actuating the unit for the suction and expulsion of solutions, means for the programmed control of the operating cycles of the means for the closure of the flexible tubes by pinching, means for the input of operational instructions by a keyboard and an extension for connection to a non-sterile container, the container having a twist-off valve at one end and a male Luer lock at the other.

12. Apparatus for the filling of containers for pharmaceutical uses comprising a casing which envelops the set of drive and control members and has supports for containers holding the medicinal starting solutions and containers for the medicinal output solutions, the apparatus being characterized in that it comprises means for supporting and locating a unit for the suction and expulsion of the solutions, combined with a distributor for defining the liquid inlets and outlets, the apparatus having means for the closure of the flexible inlet and outlet tubes of the distributor by pinching, means for actuating the unit for the suction and expulsion of solutions, means for the programmed control of the operating cycles of the means for the closure of the flexible tubes by pinching, means for the input of operational instructions by a keyboard and a housing for receiving the actuating end of the plunger of the unit for the suction and expulsion of solutions and of air, which housing includes a load cell that converts the force exerted by the plunger into a signal which is processed by the control device of the apparatus and which is related to the pressure exerted by the suction and expulsion unit by means of the fixed datum of the diameter of the plunger and the force exerted, measured by the load cell, the actual pressure being adjusted to a predetermined value by control of the drive motor.

* * * * *

UNITED STATES PATENT AND TRADEMARK OFFICE

CERTIFICATE OF CORRECTION

PATENT NO. : 7,117,901 B2
APPLICATION NO. : 10/084520
DATED : October 10, 2006
INVENTOR(S) : Enric Martinell Gisper-Sauch et al.

It is certified that error appears in the above-identified patent and that said Letters Patent is hereby corrected as shown below:

On Title page item 75
One of the Inventor's has been omitted. Please insert:

-- Victor Grifols Lucas, Barcelona (ES) --.

Signed and Sealed this

Ninth Day of January, 2007

JON W. DUDAS
*Director of the United States Patent and Trademark Office*